United States Patent [19]

Hoover et al.

[11] Patent Number: 4,972,232

[45] Date of Patent: Nov. 20, 1990

[54] FUSING APPARATUS HAVING AUTOMATIC NIP WIDTH ADJUSTMENT MECHANISM

[75] Inventors: Linn C. Hoover, Rochester; John E. Derimiggio, Fairport, both of N.Y.

[73] Assignee: Eastman Kodak Company, Rochester, N.Y.

[21] Appl. No.: 402,397

[22] Filed: Sep. 5, 1989

[51] Int. Cl.[5] ..... G03G 15/20

[52] U.S. Cl. ..... 355/295; 219/216; 355/282

[58] Field of Search ..... 355/282, 290, 295; 219/216, 469; 432/60; 100/168, 169, 176

[56] References Cited

U.S. PATENT DOCUMENTS

| | | | |
|---|---|---|---|
| 3,809,861 | 5/1974 | Braun | 219/469 |
| 3,936,658 | 2/1976 | Traister et al. | 219/216 |
| 4,147,501 | 4/1979 | Goshima et al. | 355/282 X |
| 4,269,594 | 5/1981 | Umans et al. | 355/290 X |
| 4,341,458 | 7/1982 | Glasa et al. | 355/295 X |

FOREIGN PATENT DOCUMENTS

| | | | |
|---|---|---|---|
| 0004046 | 1/1980 | Japan | 355/290 |

*Primary Examiner*—A. T. Grimley
*Assistant Examiner*—William J. Royer
*Attorney, Agent, or Firm*—Tallam I. Nguti

[57] ABSTRACT

A roller type fusing apparatus, in which a fuser or pressure roller is movable, includes a device for forming a fusing nip, having a desired nipwidth, by moving the movable roller from a first light surface-to-surface contact position, to a compressing and deforming contact second position with the other roller. The fusing apparatus further includes a mechanism for automatically correcting or adjusting for fusing nipwidth misadjustments which are caused by a reduction in the size of any of rollers. Such misadjustments normally result in poor and unacceptable fusing quality due to the nipwidth of subsequently formed fusing nips being undesirably narrower than the desired nipwidth setting. The mechanism includes a displacement assembly, operative with the nip forming device, for automatically displacing the movable roller from a misadjusted gapped or spaced third position back to the adjusted, light surface-to-surface contact first position, prior to formation of a fusing nip. In this manner, the formation of a fusing nip that has the desired nipwidth is ensured.

11 Claims, 1 Drawing Sheet

FUSING APPARATUS HAVING AUTOMATIC NIP WIDTH ADJUSTMENT MECHANISM

BACKGROUND OF THE INVENTION

This invention relates to fusing apparatus, and more particularly to a mechanism in a roller type fusing apparatus for automatically correcting or adjusting for nipwidth misadjustments which may be caused by a reduction in the size of any of the rollers. Such a size reduction may result in poor quality and unacceptable fusing since the width of a subsequently formed fusing nips may each be undesirably narrower than a desired nipwidth setting.

In electrostatographic copiers and printers in which an electrostatic latent image can be created on an image-bearing member, developed with toner particles, and then transferred to a suitable receiver or copy sheet of paper, it is well known to use heat and pressure, for example, to fuse such toner particles to the receiver or copy sheet in order to create a permanent copy. As disclosed for example in U.S. Pat. Nos. 3,449,548; 3,754,819 and 3,874,843, such fusing can be accomplished with roller type fusing apparatus in which the copy sheet is passed through a fusing nip formed by a heated fuser roller and a usually unheated pressure roller. Such a fusing nip conventionally is formed by moving one of the rollers, such as the pressure roller, from an arbitrary first position, to a second position relative to the other roller.

The quality of the permanent copy created by fusing toner images through such a nip depends on the sufficiency of the heat and pressure applied to the copy sheet at such a nip. Accordingly, efforts at achieving and maintaining desired fusing quality, for example, have included the practice of attempting to operate such heat and pressure fusing apparatus not only at specific and predetermined settings for the temperature of the fuser roller, but also for the nipwidth of such a fusing nip.

Conventionally, a desired nipwidth for such a fusing nip is achieved, for example, by placing a transparent member between the fuser and pressure rollers, manually moving the pressure or movable roller from such an arbitrary first position into compression with the fuser or other roller, and then, by trial and error, measuring the nipwidth from the impression or footprint of the rollers on the transparent member. Unfortunately however, it is usually a difficult problem achieving and maintaining a desired setting for the nipwidth of fusing nips formed in this trial and error manner. This is because, over the life of such a fusing apparatus, the fuser roller may be replaced several times with the possibility of some of the replacement rollers, due to manufacturing tolerances, being smaller than the initial fuser roller. Additionally, the size of each such fuser roller may also shrink over time due to factors such as release oil starvation or large operating temperature changes. Such shrinkage or reduction in the size of the fuser roller ordinarily will cause the surfaces of the fuser and pressure rollers to be misadjusted from their initially set first position. Misadjustments in the position of the surfaces of the rollers consequently will result in nipwidth misadjustments that will thereafter tend to cause a formed fusing nip to have a width that is different in size from, for example, that will be narrower than, the desired nipwidth setting.

Normally, unless such a narrower nipwidth is corrected or adjusted back to the desired setting, the heat and pressure being applied thereat to the copy sheet will likely be insufficient, and so may result in poor and unacceptable fusing quality.

SUMMARY OF THE INVENTION

It is therefore an object of the present invention to provide a mechanism in a roller type fusing apparatus for automatically correcting or adjusting for fusing nipwidth misadjustments which may be caused by a reduction in the size of one of the rollers.

In accordance with the present invention, a roller type fusing apparatus, in which the fuser or pressure roller is movable, includes means for moving the movable roller from first position in which the rollers are in light surface-to-surface contact, to a second position in which the rollers are in compressing and deforming contact, thereby forming a fusing nip that has an adjusted and desired nipwidth. The apparatus further includes a mechanism for automatically displacing the movable roller from a misadjusted third position in which the rollers are spaced apart, back to its light surface-to-surface contact first position, prior to the movable roller being moved by the moving means from such first position, to the compressing and deforming contact second position, thereby ensuring formation of a fusing nip that has the desired nipwidth.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
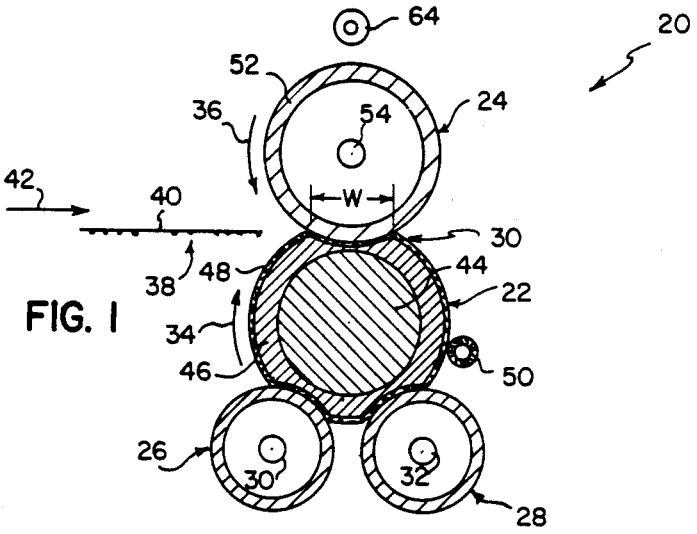
FIG. 1 is a schematic of a fuser and pressure roller type fusing apparatus.

Referring now to FIG. 1, an apparatus suitable for fusing images in an electrostatographic copier or printer is generally designated 20, and includes a fuser roller 22, a pressure roller 24, and a pair of heated rollers 26, 28 that are heated internally by heat sources 30, 32, respectively. The fuser roller 22 is heated externally by the heater rollers 26, 28. As shown for example, the fuser roller 22 is fixed, and the pressure roller 24 is movable relative to the fuser roller. The fuser roller, however, could be made movable, and the pressure roller fixed. The movable, pressure roller 24 therefore can be moved to form a fusing nip 30 with the fuser roller 22. As such, fuser roller 22 and pressure roller 24 can be rotated by conventional means (not shown) in the directions of the arrows 34, 36, respectively, for fusing toner images 38 on a copy sheet of paper 40 by driving the copy sheet 40 through the nip 30 in the direction of the arrow 42.

As illustrated in FIG. 1, the fuser roller 22 consists of a rigid core 44 which is covered by a layer of compliant, resilient material 46, for example, silicone rubber. The layer 46 further includes a smooth and compliant outside surface 48 that is suitable for making contact with the toner images 38 during fusing. To prevent toner from substantially offsetting to the surface 48 of the fuser roller 22, release oil can be applied to the fuser roller by a device 50, such as a release oil wicking roll. The release oil is also useful in maintaining the size and the condition of the fuser roller, particularly its compliancy.

Unfortunately, however, the factors affecting the need by the fuser roller 22 for such release oil are often unpredictable. Consequently, there are times in the life of a fuser roller 22 during which it may be starving for release oil. Such release oil starvation has been known to cause the fuser roller 22, notably the compliant layer 46, to shrink in size. Additionally, the compliant layer 46 can also shrink in size due to extremes between the temperatures of the fuser roller during fusing and shutdown periods.

Furthermore, within the apparatus 20, the fuser roller 22 periodically has to be replaced because of such shrinkage and other reasons such as scratches on the surface 48. Occasionally, a replacement roller, due to manufacturing tolerances, may unfortunately be smaller than the one being replaced.

In roller type fusing apparatus in which the pressure roller has a construction similar to that of the fuser roller, both the fuser and pressure rollers could similarly suffer from the size change problems described here.

Figure 2:
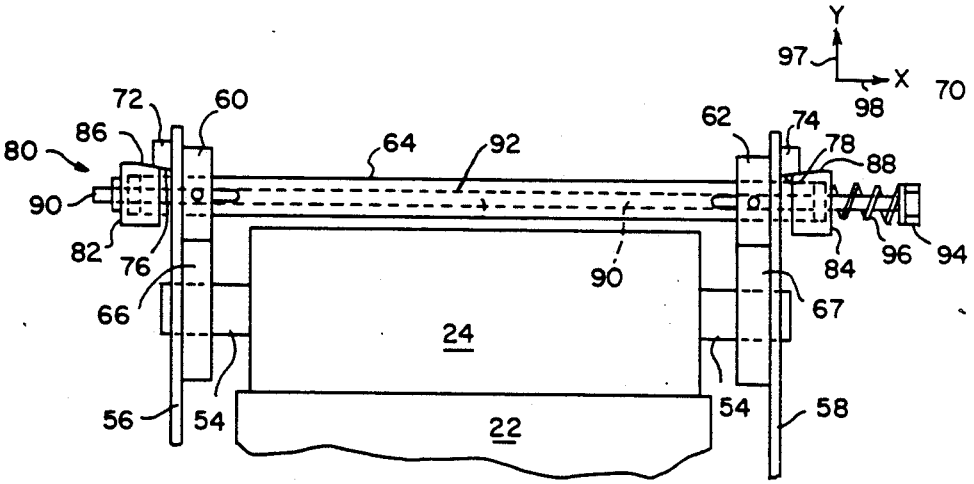
FIG. 2 is a partial side view of such a fusing apparatus including the mechanism of the present invention.

Within the apparatus 20, the pressure roller 24, as shown, may consist simply of a rigid metallic core 52, and a shaft 54 through its center for supporting it within the apparatus 20. As shown in FIG. 2, the shaft 54 is supported at each end by mechanism plates 56, 58. Vertical slots (not shown) in the plates 56, 58 allow the shaft 54, and hence the pressure roller 24 to be movable through three different positions relative to the fuser roller 22.

The first position is one in which the pressure roller 24 is in light surface-to-surface contact with the fuser roller 22. The second position is one in which the pressure roller is in compressing and deforming contact or engagement with the fuser roller. For proper operation of the apparatus 20, such first and second positions are desired positions. The third position, however, is a misadjusted position in which the surface of the pressure roller is spaced from that of the fuser roller. As discussed above, for example, the fuser roller 22 can shrink in size for any number of reasons. When such a reduction in the size of the fuser roller occurs, the surface of the pressure roller 24 (which when in the desired light surface-to-surface contact first position had been in contact with that of the fuser roller 22) may as a consequence become spaced or gapped from the surface of the fuser roller, thereby causing the pressure roller to assume such a misadjusted third position.

The pressure roller 24 thus can be moved a predetermined distance, from an unloaded position, that is, its first or light surface-to-surface contact position, to the second or loaded position in which it compresses and deforms the compliant layer 46 of the fuser roller 22, thereby forming a fusing nip 30 that has a desired nipwidth 'W'. The light surface-to-surface contact first position is such that there is or should be no gap between the two contacting surfaces, and such that there is no appreciable compression or deformation of the layer 46 of the fuser roller. The apparatus 20 should initially be set up so that the pressure roller 24 is normally idle and unloaded, and hence in such first or light surface-to-surface contact position. The fusing nip 30 should therefore be created or formed only for, and during fusing or run periods of such apparatus.

A device within the apparatus 20 for forming such a fusing nip 30 includes means for loading, that is, moving the pressure roller 24, from its first light surface-to-surface contact position to its second position in which its surface comes into such fusing nip forming, compressing, and deforming contact with the fuser roller 22. The moving means, for example, may consist of a pair of eccentric cams 60, 62 each having eccentricity 'e' (not shown), that are carried rotatably by a cam shaft 64, and conventional means (not shown) for driving the cam shaft. For loading and unloading the pressure roller 24 relative to the fuser roller 22, cams 60, 62 act on corresponding bearing blocks 66, 67 which are mounted to the shaft 54.

The cam shaft 64, which is supported at each end by the mechanism plates 56, 58, is also movable down towards, and up away from the bearing blocks 66, 67. Ordinarily, the apparatus 20 is set up such that the cams 60, 62 are in constant contact with the bearing blocks 66, 67. Given such constant contact, rotation of the cam shaft 64 so as to bring the nose of the cams 60, 62, (which each have eccentricity 'e'), into direct and full contact with the bearing blocks 66, 67, will move the pressure roller 24 a predetermined total distance 2'e' into deforming and compressing engagement with the fuser roller 22.

When the pressure roller 24 is moved such a predetermined distance from its light surface-to-surface or gap-closing contact first position with, and into the fuser roller 22, the fuser roller, or more specifically, its compliant layer 46, will be compressed to a point where the nipwidth of the formed fusing nip 30 is 'W' as shown in FIG. 1. The width 'W' is predetermined and desired such that toner images 38 on a copy sheet 40, when passed through the nip 30 will be subjected to just the desired amount of heat and pressure, at the given temperature and speed settings of the apparatus 20, so as to produce high quality fusing results.

On the other hand, if the pressure roller 24 is moved into the fuser roller 22 instead from the misadjusted or gapped third position relative to such fuser roller, the maximum movement of the pressure roller towards the fuser roller will still be equal to the predetermined distance 2'e', but part of such displacement will be taken up by the gap or space between it and the fuser roller, and consequently the actual compression of the compliant layer 46 will be less, and the width of the fusing nip 30 formed will be undesirably narrower than 'W'. As pointed out above, although the rollers are initially set up and adjusted to be in the light surface-to-surface contact first position, such a misadjustment or gap between the roller surfaces can develop or be created as a result of manfacturing tolerances which are introduced when a fuser roller is replaced, or as a result of the fuser roller 22 shrinking in size.

In order to ensure high quality fusing, such a misadjustment or gap, as described above, should be corrected, for example, the gap or space should be closed in order to adjust the nipwidth of the fusing nip formed thereafter, back to the desired nipwidth setting 'W'. Accordingly, for automatically adjusting or correcting the nipwidth of a fusing nip formed following such a misadjustment, the apparatus 20 includes the mechanism of the present invention, designated generally as 70 in FIG. 2. As illustrated in FIG. 2, the mechanism 70 includes first and second locking blocks 72, 74 that are mounted to the mechanism plates 56, 58, respectively, above the cam shaft 64. Each locking block 72, 74 has a ten degree decline with a wedge-shaped cam surface 76, 78, respectively, that faces towards the pressure roller 24. The apparatus 70 further includes a displacement assembly or means 80 associated with the wedge-shaped cam surfaces 76, 78 of blocks 72, 74, for automatically displacing the cams 60, 62, and hence the pressure roller 24 in contact therewidth, from the misadjusted or gapped third position, into its initial unloaded first or light surface-to-surface contact position with the fuser roller 22.

When the cams 60, 62 and the pressure roller 24 are in such a misadjusted or gapped third position, the effect of the displacement means 80 cooperating with the blocks 72, 74, will be to displace the pressure roller 24 downwardly into its first, light surface-to-surface or gap-closing contact position with the fuser roller 22. Following each such automatic displacement, the pressure roller 22 will be locked into such first position by the locking blocks 72, 74. By displacing and locking the pressure roller 24 as such, the displacement means 80 and the blocks 72, 74 effectively eliminate any misadjustment or gap created or developed between the surfaces of the pressure and fuser rollers due to manufacturing tolerances (when the fuser roller is replaced) or due to the fuser roller shrinking in size for any number of reasons.

In this manner, the fusing nip 30 formed by moving the pressure roller 24, from such first light surface-to-surface or gap-closing contact position, to its compressing and deforming contact second position with the fuser roller 22, will have the desired nipwidth 'W'.

As shown in FIG. 2, the displacement means 80 includes a pair of displacement blocks 82, 84, each having a ten degree wedge-shaped, cam follower surface 86, 88, respectively. The follower surfaces 86, 88, as shown, are in following displacement and locking contact with the wedge-shaped cam surfaces 76, 78 of the locking blocks 72, 74. Displacement blocks 82, 84 are mounted on first and second projecting ends of a moveable rod 90 which is disposed movably within a hollow 92 within the cam shaft 64. The displacement block 82 is mounted fixedly at the first end of the rod 90, whereas the displacement block 84 is mounted slidably over the second end of the rod 90, spaced from an end cap 94.

The means 80 further includes force means such as a loaded spring 96 which is mounted within the spacing between the displacement block 84 and the end cap 94, over the second end of the rod 90. One end of the spring 96 is connected to the fixed end cap 94, and the other end is connected to the slidable displacement block 84.

As assembled, the rod 90 and the spring 96 form pulling and pushing means for moving the displacement blocks 82, 84 together by pushing inwardly on the slidable block 84 while simultaneously pushing outwardly on the fixed end cap 94. Pushing outwardly on the end cap 94 causes the moveable rod 90 to move within the hollow 92 towards its second end on which is mounted the end cap 94. As such, the first displacement block 82 which is mounted fixedly at the first end of the rod 90, is moved with the rod 90 equally towards such second end, and hence into increasing displacement contact with the first locking block 72. Moving the blocks 82, 84 together in this manner causes the inclining surfaces 86, 88 to follow the declining surfaces 76, 78 of blocks 72, 74 downwards, thereby equally displacing the cams 60, 62, and the pressure roller 24 in contact therewidth, from the misadjusted gapped third position into the desired light surface-to-surface or gap-closing contact first position with fuser roller 22.

The force means or spring 96 should be strong enough to force the shaft 64 (of the cams 60, 62), and the shaft 54 (of the pressure roller 24), when in the misadjusted gapped third position, to move into such gap-closing contact first position with the fuser roller 22. Such force means or spring 96, however, should not be so strong as to cause the pressure roller 24 to appreciably compress and deform the compliant layer 46 of the fuser roller 22 beyond merely making such light surface-to-surface or gap-closing contact. Such compression and deformation must be achieved only by using the moving means or cams 60, 62 to further move the pressure roller 24 from its first to its second position against the fuser roller 22.

Additionally, the spring 96 should be such that once it has moved the pressure roller 24 into such light surface-to-surface or gap-closing contact with the fuser roller 22, any further tendency by the spring 96 to continue to displace the pressure roller 24 as such, will be resisted and neutralized by the compliant layer 46 of the fuser roller pushing back. During fusing periods, when the pressure roller 24 is loaded, that is, moved by the cams 60, 62, as described above, into compressing and deforming contact with the fuser roller 22, the compliant layer of the fuser roller 22 will similarly resist and push back with even greater force.

The apparatus 20 is such that whether the fuser and pressure rollers are in the loaded or unloaded positions, the force generated by the compliant layer of the fuser roller pushing back, as described above, will act frictionally between the wedge-shaped surfaces 76, 86 and 78, 88, respectively. The angles and shapes of the surfaces are such that, as shown, such a friction force will have a significantly larger locking y-component 97, than a backward displacement x-component 98. As a consequence, the wedge-shaped surfaces, after downward displacement of the pressure roller, will rather lock than slip, and hence will be locked into the position they achieve following such downward displacement of the pressure roller 24.

As can be seen, using the mechanism of the present invention will automatically ensure that the nipwidth of a fusing nip formed by a fuser and pressure roller type fusing apparatus, even following an undesirable reduction in the size of a roller such as the fuser roller, will remain constant, and hence be equal to an initial desired nipwidth setting. As a result, the desired sufficiency of heat and pressure applied to copy sheets at such a nip will be maintained, and the quality of permanent copies produced will be desirably high.

Although the present invention has been described with particular reference to a preferred embodiment, it is understood that variations and modifications thereto can be effected within the scope and spirit of the invention.

What is claimed is:

1. A fuser and pressure roller type fusing apparatus in which the fuser or pressure roller is movable, the fusing apparatus including:

(a) means for moving the movable roller, from a first position in which the rollers are in light surface-to-surface contact, to a second position in which the rollers are in compressing and deforming contact, thereby forming a fusing nip having an adjusted and desired nipwidth said moving means including a pair of rotatable cams acting on corresponding blocks mounted to the movable roller; and (b) a mechanism for automatically displacing the movable roller, from a third position in which the rollers are spaced apart, back to said light surface-to-surface contact first position, prior to the movable roller being moved by said moving means from said first position to said second compressing and deforming contact second position.

2. A fusing apparatus comprising:

(a) a fuser roller;

(b) a movable pressure roller having first, second and third positions relative to said fuser roller;

(c) a fusing nip having a desired nipwidth, said fusing nip being formed by moving said pressure roller from said first position to said second position;

(d) means including a pair of rotatable cams acting on corresponding blocks mounted to said pressure roller for moving said pressure roller from said first position to said second position; and (e) a mechanism for automatically displacing said pressure roller from said third position to said first position, prior to the movement of said pressure roller by said moving means from said first position to said second position.

3. The apparatus of claim 2 wherein said first position of said pressure roller is one in which said pressure roller is in light surface-to-surface contact with said fuser roller.

4. The apparatus of claim 2 wherein said second position of said pressure roller is one in which said pressure roller is in compressing and deforming contact with said fuser roller.

5. The apparatus of claim 2 wherein said third position of said pressure roller is one in which said pressure roller is spaced from said fuser roller.

6. The apparatus of claim 2 wherein said nipwidth adjusting mechanism further includes:

(a) first and second locking blocks mounted at first and second ends, respectively, of the pressure roller for locking said moving means into contact with the pressure roller, said first and second locking blocks having first and second wedge-shaped cam surfaces respectively; and (b) displacement means, useful with said moving means in said third positon for automatically displacing the pressure roller from said third position back to said first position, prior to the movement of said pressure roller by said moving means from said first position to said second position.

7. The apparatus of claim 6 wherein said displacement means comprises:

(i) first and second displacement blocks associated with said moving means at the first and second ends, respectively, of the pressure rollér, said first and second displacement blocks having first and second cam follower surfaces, respectively, and said first and second follower surfaces being in displacement and locking contact with said first and second wedge-shaped cam surfaces, respectively, of said first and second locking blocks; and (ii) pulling and pushing means for automatically pulling said first follower surface of said first displacement block into increasing displacement contact with said first wedge-shaped cam surface of said first locking block, and for simultaneously and automatically pushing said second follower surface of said second displacement block into increasing displacement contact with said second wedge-shaped cam surface of said second locking block.

8. The mechanism of claim 6 wherein said first and said second wedge-shaped cam surfaces of said first and said second locking blocks consist each of a ten degree (10°) decline.

9. The mechanism of claim 7 wherein said first and second follower surfaces of said first and second displacement blocks are each wedge-shaped.

10. The mechanism of claim 7 wherein said pulling and pushing means comprises:

(a) a hollow shaft associated with said moving means, said hollow shaft being supported rotatably at each end of the pressure roller;

(b) a rod disposed movably within said hollow shaft, said rod having first and second ends, said first end of the rod being attached fixedly to said first displacement block, and said second end of the rod being attached slidably to said second displacement block; and (c) force means connected to an end cap at said second end of the rod, and to said slidably attached second displacement block, for pulling said first displacement block inwardly into increasing displacement contact with said first locking block by pushing outwardly on said end cap, and for pushing said slidably attached second displace contact with said second locking block.

11. The mechanism of claim 9 wherein said force means consists of a spring.

* * * * *

UNITED STATES PATENT OFFICE

CERTIFICATE OF CORRECTION

Patent No. 4,972,232 Dated November 20, 1990

Inventor(s) Linn C. Hoover & John E. Derimiggio

It is certified that error appears in the above-identified patent and that said Letters Patent is hereby corrected as shown below:

Claim 10:

In column 8, line 43, after "second" delete "displace" and insert --displacement block into increasing displacement--.

Signed and Sealed this

Twenty-fifth Day of February, 1992

*Attest:*

HARRY F. MANBECK, JR.

*Attesting Officer*

*Commissioner of Patents and Trademarks*